US012782098B2

(12) United States Patent
Drouault et al.

(10) Patent No.: US 12,782,098 B2
(45) Date of Patent: Nov. 3, 2026

(54) AUTONOMOUS PYROTECHNIC IGNITER SIMULATOR

(71) Applicant: MBDA FRANCE, Le Plessis-Robinson (FR)

(72) Inventors: Xavier Drouault, Le Plessis Robinson (FR); François Rollin, Le Plessis Robinson (FR); Robert Lacoste, Viroflay (FR)

(73) Assignee: MBDA FRANCE, Le Plessis-Robinson (FR)

( * ) Notice: Subject to any disclaimer, the term of this patent is extended or adjusted under 35 U.S.C. 154(b) by 81 days.

(21) Appl. No.: 18/881,931

(22) PCT Filed: May 25, 2023

(86) PCT No.: PCT/EP2023/064140
§ 371 (c)(1),
(2) Date: Dec. 8, 2025

(87) PCT Pub. No.: WO2024/017528
PCT Pub. Date: Jan. 25, 2024

(65) Prior Publication Data

US 2026/0139933 A1 May 21, 2026

(30) Foreign Application Priority Data

Jul. 11, 2022 (FR) ..... 2207007

(51) Int. Cl.
*F42C 21/00* (2006.01)
*F42B 3/12* (2006.01)

(52) U.S. Cl.
CPC ..... *F42C 21/00* (2013.01); *F42B 3/121* (2013.01)

(58) Field of Classification Search
CPC .... F42B 3/10; F42B 3/12; F42B 3/121; F42B 3/122; F42B 3/13; F42B 35/00; F42C 19/12; F42C 21/00
(Continued)

(56) References Cited

U.S. PATENT DOCUMENTS 4,776,277 A * 10/1988 Fiedler ..... G01R 31/50 73/167
4,990,889 A 2/1991 Lebsock
(Continued)

FOREIGN PATENT DOCUMENTS

CN 111879192 A * 11/2020 ..... F42C 21/00
DE 29714153 U1 10/1997
WO WO-2024017528 A1 * 1/2024 ..... F42B 3/12

OTHER PUBLICATIONS

Machine translation of CN 111879192 A (Year: 2020).*
(Continued)

*Primary Examiner* — James S Bergin
(74) *Attorney, Agent, or Firm* — Dickinson Wright PLLC

(57) ABSTRACT

The pyrotechnic igniter simulator (1) has a detection element (5) that is able to detect at least one ignition pulse, a microcontroller (6) that is able to determine characteristics of the ignition pulse detected by the detection element (5) and to control an impedance block (7) depending on these characteristics, the microcontroller (6) being able to be configured remotely, and the impedance block (7) being able to be simulated at one of two different impedance values depending on these characteristics, one of the impedance values, referred to as the high value, simulating activation of the igniter in response to the detected ignition pulse, and the other impedance value, referred to as the low value, simulating non-activation of the igniter in response to the
(Continued)

detected ignition pulse, the resulting simulator (1) being autonomous and especially proficient.

13 Claims, 2 Drawing Sheets

(58) Field of Classification Search
USPC ..... 102/202.5, 206, 215
See application file for complete search history.

(56) References Cited

U.S. PATENT DOCUMENTS

| | | | | |
|---|---|---|---|---|
| 9,618,309 | B2 * | 4/2017 | Barthold | F42C 19/12 |
| 2018/0299238 | A1 * | 10/2018 | Wangerin | F42C 11/06 |

OTHER PUBLICATIONS

PCT Opinion in PCT/EP2023/064140 (Year: 2023).*
International Search Report and Written Opinion with English Translation for PCT Application No. PCT/EP2023/064140, dated Jul. 14, 2023, 10 pages.

* cited by examiner

AUTONOMOUS PYROTECHNIC IGNITER SIMULATOR

CROSS-REFERENCE TO RELATED APPLICATION(S)

This present application is a national stage application of International Patent Application No. PCT/EP2023/064140, filed May 25, 2023, which claims priority to French Patent Application No. 2207007, filed Jul. 11, 2022, the disclosures of which are hereby incorporated by reference in their entireties.

TECHNICAL FIELD

This disclosure relates to an autonomous pyrotechnical ignition device simulator and a method of simulating a pyrotechnical ignition device.

BACKGROUND

We know that many systems, particularly weapon systems, use electro-pyrotechnic devices comprising pyrotechnical ignition devices to trigger them or certain of their elements or members.

A pyrotechnical ignition device usually comprises a filament through which an electric current (corresponding to an electrical firing pulse) can flow when the ignition device is ignited. This electric current is configured to heat the filament so that it triggers the combustion of a powder, thus creating the ignition.

In particular, many weapon systems such as missiles, missile launchers, firing installations or countermeasure systems use equipment, for example retractors, cylinders, valves, bolts, gas generators, etc., fitted with electro-pyrotechnic devices. These electro-pyrotechnic devices are also widely used in the space industry (pyromechanisms for delay relays, valves, stage and cap separation systems, stage separation cylinders, etc.), as well as in the automotive industry (in the car airbags, for example).

This widespread use of electro-pyrotechnic devices is due in particular to the fact that no other current technology, for example electrical, is capable of providing the same performance as a pyrotechnic primer, It is of course generally necessary to be able to validate the correct operation of such an electro-pyrotechnic device and, more particularly, that of the entire firing chain of an electro-pyrotechnic device, before it is used.

However, there is currently no completely satisfactory solution for carrying out such validation, as existing solutions are generally too complex or insufficiently representative of the elements being simulated.

There is therefore a need for a high-performance (and autonomous) solution for simulating a pyrotechnical ignition device for an electro-pyrotechnic device.

SUMMARY

The purpose of the present disclosure is to provide a solution to meet this need. It concerns a pyrotechnical ignition device simulator, said simulator being suitable for receiving an electrical firing pulse for activating a pyrotechnic ignition device.

According to the disclosure, said pyrotechnical ignition device simulator comprises at least:

- a detection element capable of detecting at least one firing pulse received;

- a microcontroller able to determine one or more characteristics of the firing pulse detected by the detection element and to drive an impedance block as a function of this or these characteristic(s), said microcontroller being able to be configured remotely; and
- said impedance block which is able to be simulated according to one of two different impedance values as a function of said characteristic(s), one of said impedance values called high simulating an activation of the ignition device in response to the detected firing pulse and the other impedance value called low simulating an absence of activation of the ignition device in response to the detected firing pulse.

The disclosure therefore provides a pyrotechnical ignition device simulator for simulating the behaviour of a pyrotechnical ignition device. This simulator is particularly powerful. As specified below, in particular said pyrotechnical ignition device simulator is autonomous (being able in particular to be powered by energy supplied during ignition), is capable of reversibly simulating the triggering of a pyrotechnical ignition device and comprises means capable of recovering and recording the results of the simulation and transmitting them remotely, as well as configuring the parameters of the simulated pyrotechnical ignition device.

This solution is applicable to any system, and in particular to any weapon system, incorporating an electro-pyrotechnic device.

In a preferred embodiment, said pyrotechnical ignition device simulator comprises an RFID (Radio Frequency Identification) type chip label, capable of transmitting and receiving data remotely.

Advantageously, the chip label comprises an antenna and a non-volatile memory capable of recording the characteristic(s) of a firing pulse, determined by the microcontroller.

Advantageously, said memory is powered by at least one of the following energy sources:

- the energy stored when the firing pulse is received;
- the energy supplied by a management device cooperating remotely with the chip label.

In a particular embodiment, the pyrotechnical ignition device simulator comprises a charging element capable of recovering energy from a firing pulse received and charging a first (short-term) energy reserve intended to supply electronic components of the ignition device simulator during the emulation period.

In addition, advantageously, the charging element is also able to charge a second (longer-term) energy reserve intended to supply the microcontroller in order to record in a memory the determined characteristic(s) of a firing pulse.

Furthermore, in a particular embodiment, the microcontroller is able to determine at least one of the following characteristics of a detected firing pulse:

- an intensity of the (electrical) firing pulse current;
- a duration of the firing pulse;
- a maximum voltage measured;
- a particular type of event, specified below, concerning the firing pulse.

Advantageously, the microcontroller is also able to determine the number of firing pulses detected, when several firing pulses are detected.

Advantageously, the microcontroller can be configured (remotely) for at least one of the following parameters:

- a delay between the reception of a firing pulse and a corresponding simulation;
- a minimum current for a firing pulse to be considered a correct firing pulse;

a duration of holding the impedance block at said high impedance value (i.e. in a high impedance state) after detection of a firing pulse.

In addition, the microcontroller can be remotely controlled to enable the simulator, after a simulation following the detection of a firing pulse, to carry out a new simulation for a new firing pulse.

The present disclosure also relates to a system for simulating a pyrotechnical ignition device comprising at least one pyrotechnical ignition device simulator such as that described above and a remote management device (i.e. reading, control and/or configuration) which is able to communicate via a wireless link with the pyrotechnical ignition device simulator.

In a particular embodiment, the simulation system comprises a plurality of pyrotechnical ignition device simulators and said management device is adapted to communicate with said plurality of pyrotechnical ignition device simulators.

This disclosure also relates to a method of simulating a pyrotechnical ignition device.

According to the disclosure, said method, according to which an electrical firing pulse configured to the activation of a pyrotechnical ignition device is adapted to be received, comprises:

- a detection step consisting in detecting, by means of a detection element, at least one firing pulse received;
- a control step consisting in determining, with the aid of a microcontroller, one or more characteristics of the firing pulse detected in the detection step in order to drive an impedance block as a function of this or these characteristic(s), said microcontroller being capable of being configured remotely; and
- a simulation step consisting in simulating said impedance block according to one of two different impedance values as a function of said characteristic or characteristics determined in the checking step, one of said impedance values, called high, simulating an activation of the ignition device in response to the detected firing pulse and the other impedance value, referred to as low, simulating an absence of activation of the ignition device in response to the detected firing pulse.

In a preferred embodiment, said method comprises a step of remotely configuring the microcontroller.

BRIEF DESCRIPTION OF THE FIGURES

The attached figures will make it clear how the disclosure may be carried out. In these figures, identical references designate similar elements.

DETAILED DESCRIPTION

Figure 1:
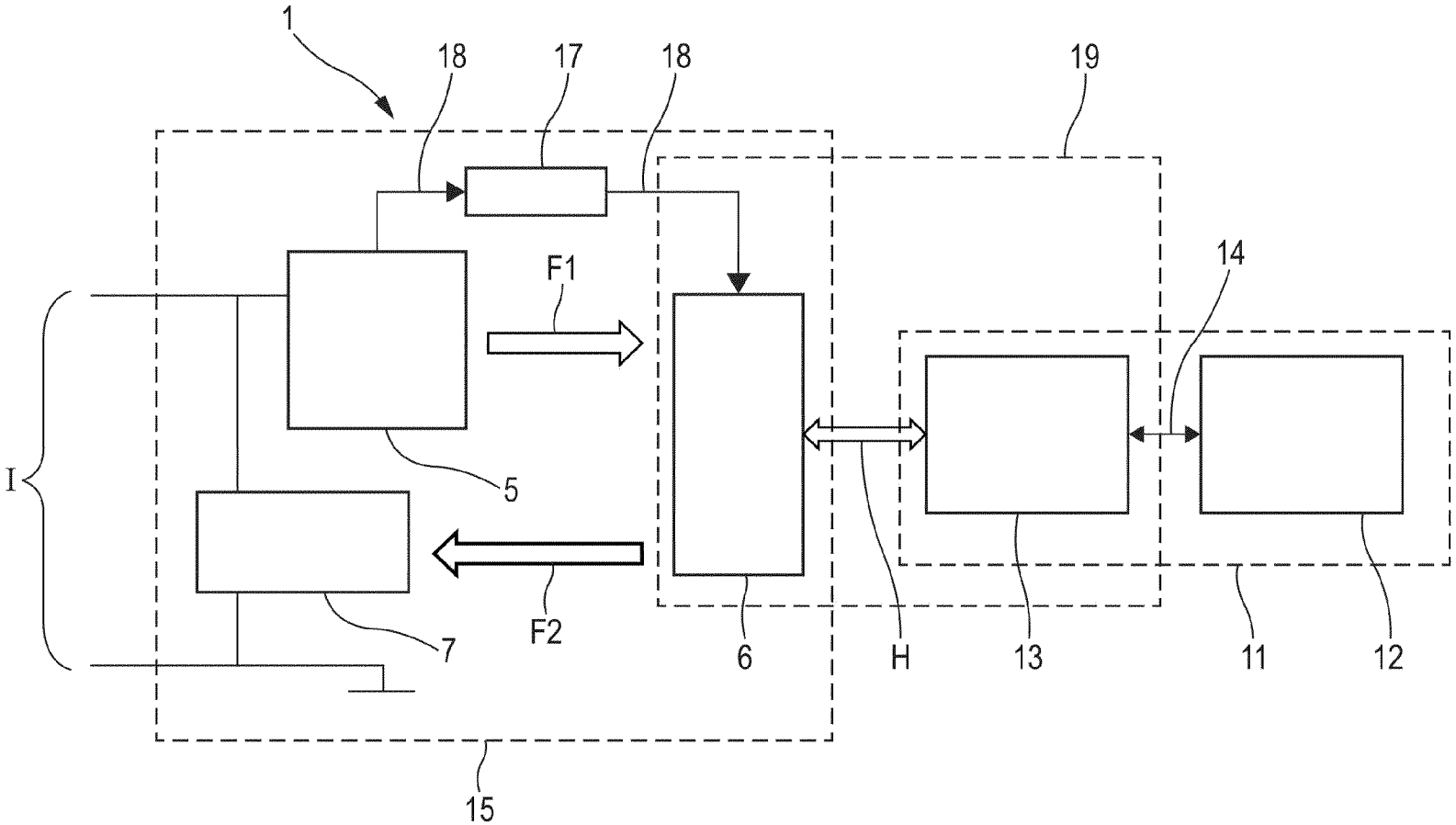
FIG. 1 is a block diagram of an embodiment of a pyrotechnical ignition device simulator.

The simulator 1 used to illustrate the disclosure and shown schematically in a preferred embodiment in FIG. 1 is a pyrotechnical ignition device simulator.

Figure 2:
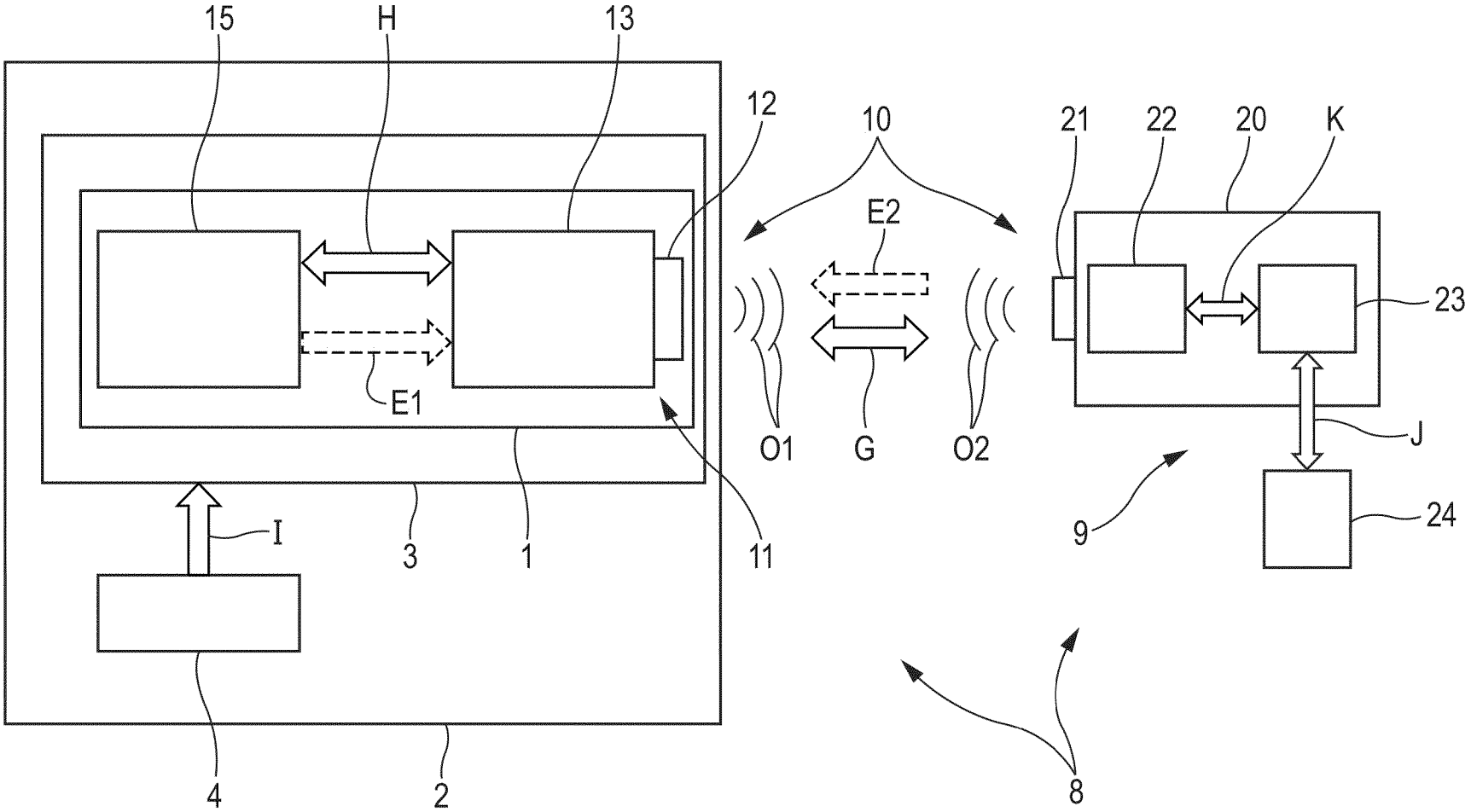
FIG. 2 is a block diagram of a particular embodiment of a simulation system of a pyrotechnical ignition device comprising a pyrotechnical ignition device simulator and a remote management device.

The simulator 1 is mounted on a system 2, for example a weapon system, as shown in FIG. 2, by being integrated into an electro-pyrotechnic device 3.

By way of non-limitative illustration:

- the system 2 may correspond to a weapon system such as a missile, a missile launcher, a firing installation or a countermeasure system; and
- the electro-pyrotechnic device 3 can be mounted in one of the following items of equipment or members of the system 2: a retractor, a cylinder, a valve, a bolt or a gas generator, for example.

The simulator 1 is able to receive a (electrical) firing (or activation or priming) pulse, illustrated by an arrow I in FIG. 2, which is configured to fire (or activate or prime) a pyrotechnical ignition device of the electro-pyrotechnic device 3. Such a firing pulse is generated, in the usual way, by a known firing device 4, not described further, of the system 2.

In particular, the purpose of the simulator 1 is to check that this firing pulse has the necessary characteristics to activate a real pyrotechnical ignition device if it were addressed to the latter.

As shown in FIG. 1, the simulator 1 comprises a management unit 15 which comprises:

- a detection element 5 capable of detecting a received firing pulse and taking measurements, as specified below;
- a microcontroller 6 capable of determining characteristics of the firing pulse detected by the detection element 5, on the basis of data measured in particular and received from the detection element 5 via a link F1. The microcontroller 6 is also able and configured to control, via a link F2, an impedance block 7 as a function of the characteristics thus determined; and
- the impedance block 7, which can be controlled by the microcontroller 6 to assume one of two different impedance values.

More specifically, the impedance block 7 can be simulated:

- or, according to a first (so-called high) impedance value, for example 500 Ohm, which simulates an open circuit and which is configured to simulate activation of the ignition device in response to the detected firing pulse (which is determined to be correct). In this case, the impedance block 7 is brought into a high-impedance state;
- or, according to a second impedance value (called low), for example 1 Ohm, which simulates a closed circuit and which is configured to simulate an absence of activation of the ignition device in response to the detected firing pulse. In this case, the impedance block 7 is brought into a so-called low impedance state (to indicate that the firing pulse would not be capable of activating a real pyrotechnical ignition device).

In the context of the present disclosure, the microcontroller 6 can be configured. It can also be configured remotely. For this purpose, the simulator 1 forms part of a system 8 for simulating a pyrotechnical ignition device which comprises, in addition to the simulator 1, a management device 9 (i.e. for reading, controlling and/or configuring), as shown in FIG. 2. The management device 9 is remote, i.e. it is positioned at a distance from the simulator 1.

The management device 9 is able to communicate with the simulator 1 via a wireless (communication) link 10, specified below. By way of illustration, the management device 9 can be located at a distance of between 50 cm and 1 metre, for example, to communicate with the simulator 1.

To achieve this, the simulator 1 comprises a chip label 11 (radio tag or smart tag) capable of transmitting and receiving data remotely by radio link.

In a preferred embodiment, the chip label 11 uses conventional RFID (Radio Frequency Identification) wireless communication technology to read and record data from the simulator 1 and to set the parameters of the simulator 1 remotely, without having to handle it.

The chip label 11 comprises an antenna 12 and a memory 13 linked together via a link 14. The memory 13 is of the non-volatile type, i.e. it retains (recorded) data in the absence of a power supply.

The memory 13 is able and configured to in particular to record some or all of the characteristics of a firing pulse, determined by the microcontroller 6 and received via a link H. The memory 13 can record all of the data and characteristics for a plurality of successive firing simulations.

The memory 13 is powered by at least one of the following energy sources:

- energy supplied by the management device 9 cooperating remotely with the chip label 11 (via the antenna 12), when the simulator 1 is at rest, as illustrated by an arrow E2 in FIG. 2; and/or
- energy stored when the firing pulse is received and recovered by the simulator 1, as illustrated by an arrow E1 in FIG. 2 and as explained below.

In a particular embodiment, the simulator 1 comprises a charging element 17 capable of recovering energy from a received firing pulse and charging a (short-term) energy reserve configured to power electronic components of the simulator 1 during the emulation period, as illustrated by links 18 in FIG. 1.

In addition, the charging element 17 is also able to charge a (longer-term) energy reserve configured to power the microcontroller 6 in order to record in the memory 13 specific characteristics of a firing pulse.

The simulator 1 does not therefore require a specific power supply and is therefore completely autonomous.

Furthermore, in a particular embodiment, the microcontroller 6 of the simulator 1 is able to determine at least one of the following characteristics for any firing pulse detected:

- the intensity of the electric current, which is measured via the detection element 5 of this firing pulse. To do this, we measure the voltage across a resistor through which this electric current flows;
- the measured duration of the firing pulse. The duration of the pulse is measured by simulator 1, from when a minimum electrical intensity threshold Imin is exceeded until the open circuit voltage disappears;
- a maximum voltage measured between the opening of the circuit and the end of the firing pulse; and
- a specific type of event concerning the firing pulse.

In the latter case, it may be one of the following types of event:

- a correct firing pulse (in terms of intensity and duration). To do this, the intensity of the electric current (of the firing pulse), as measured, is compared by the microcontroller 6 with a predetermined minimum electrical intensity threshold Imin and is considered correct if it exceeds this threshold. Similarly, the duration of the firing pulse as measured is compared by the microcontroller 1 with a predetermined timeout and is considered correct if it exceeds this timeout. In this case (i.e. for a correct firing pulse), the impedance block 7 is brought to the high impedance value (in a so-called high impedance state);
- a fault (the impedance block 7 then remaining at the low impedance value, for example 1 Ohm);
- a firing pulse considered to be of insufficient intensity following the aforementioned comparison (the impedance block 7 then remaining at the low impedance value);
- a firing pulse considered to have too short a duration following the aforementioned comparison (impedance block 7 then remaining at the low impedance value).

The microcontroller 6 is also able to determine, as a characteristic, the number of firing pulses detected, when several firing pulses are detected.

Preferably, the microcontroller 6 of simulator 1 determines several of the above characteristics for each firing pulse detected. The characteristics determined in this way are stored in memory 13 via a link H each time a firing pulse is detected. The microcontroller 6 and memory 13 form a control block 19.

In addition, the microcontroller 6 can be configured for one or more parameters, i.e. the (reference) values which are stored (for example in memory 13) for use by the microcontroller 6 during processing and in particular during comparisons can be modified (i.e. parameterised).

More specifically, the microcontroller 6 can be configured for at least one of the following parameters of the simulator 1:

- the timeout between the start of a firing pulse (exceeding a threshold of minimum electrical intensity Imin of the electric current of a electrical firing pulse) and the corresponding simulation of the activation of the pyrotechnical ignition device;
- a minimum current (or minimum electrical intensity threshold Imin) of a firing pulse for it to be considered a correct firing pulse, i.e. it has a sufficiently high current for firing a real pyrotechnical ignition device; and
- a holding time in a high impedance state after the detection of a firing pulse which is considered to be correct.

In the present disclosure, the microcontroller 6 is configured using the management device 9 via the wireless link 10.

To do this, the management device 9 comprises, as shown in FIG. 2, a processing unit 20 and an antenna 21. The management device 9 can be powered by a battery (not shown).

The antenna 21 is able to communicate with the antenna 12 of the chip label 11 of the simulator 1, via the wireless link 10, in the form of a communication that can be carried out in both directions as illustrated by a double arrow G in FIG. 2. To do this, antenna 12 is able to reflect radio signals 01 likely to be picked up by the antenna 21. Similarly, the antenna 21 can transmit radio signals 02 that can be picked up by the antenna 12.

More specifically, the communication from the antenna 12 to the antenna 21 can, in particular, be used to transmit parameter values relating to one or more detected firing pulses.

In addition, communication from antenna 21 to antenna 12 can be used to transmit configuration values (i.e. parameter reference values) or to supply power to simulator 1, as illustrated by the arrow E2.

In a particular embodiment, the management device 2 comprises, as shown in FIG. 2, in the processing unit 20:

- an RFID-type reader 22, linked to the antenna 21; and
- a microcontroller 23 which is connected to the reader 22 via a link K.

The management device 2 also comprises a man/machine interface 24, for example a tablet, which is connected via a link J to the microcontroller 23. This man/machine interface 24 enables, in particular, an operator to:

enter the configuration values, i.e. the parameter reference values for configuring simulator 1. These configuration values, for example the aforementioned time-out, minimum current and/or hold time, are then transmitted via the wireless link 10 to the simulator 1 as described above; and taking note (via a display on a screen of the man/machine interface 24) of the determined values of one or more parameters of a firing pulse.

Furthermore, in a particular embodiment (not shown), the system 8 comprises a plurality of simulators 1 such as that described above, and a single remote management device 9. In this particular embodiment, the management device 9 is able to communicate with all the simulators 1, via wireless links such as the link 10.

In this way, an operator can remotely reconfigure and/or re-prime a plurality of simulators 1 using a single management device 9. Such reconfigurations and/or re-priming can therefore be carried out quickly and simply, and remotely, without having to intervene on the simulators 1.

The simulator 1, as described above, is representative of an active system and is based on the real characteristics of a pyrotechnical ignition device. The characteristics of a real ignition device kept in the simulator 1 are as follows:

the time required for the filament to be triggered to create the electrical break in the primer;

the firing intensity allowing the electrical breakdown of the primer of the electric current;

the impedance of the circuit in the closed position (low independence) and in the open position (high impedance).

In a preferred embodiment, the simulator 1 is mounted in a conventional casing, for example a conventional pyrotechnic cartridge socket, such as that in which a real pyrotechnical ignition device (which is being simulated) is mounted. On the other hand, the usual filament of a real pyrotechnical ignition device is replaced by the impedance block 7 simulating the opening of the circuit.

The simulator 1 and the simulation system 8, as described above, can be used to simulate a pyrotechnical ignition device. Said simulation method is capable of receiving an (electrical) ignition pulse configured to activate a pyrotechnical ignition device. To do this, the firing device 4 generates, in the usual way, a firing pulse (with the same characteristics as a standard firing), for example on a standard pyrotechnical ignition device cartridge fitted with the simulator 1.

Said simulation method comprises:

a detection step E1 consisting in detecting, with the aid of the detection element 5, a firing pulse received;

a control step E2 consisting in determining, with the aid of the microcontroller 6, characteristics of the firing pulse detected in the detection step E1; and a simulation step E3 consisting of simulating the impedance block 7 according to one of two different impedance values as a function of said characteristics determined in the control step E2.

More specifically, the simulation step E3 simulates the impedance block 7 according to:

the so-called high impedance value simulating activation of the ignition device in response to the detected firing pulse; or the low impedance value simulating a lack of ignition device activation in response to the detected firing pulse.

In the simulation step E3, the microcontroller 6 drives the impedance block 7 in order to simulate the high impedance value or the low impedance value so as to present the upstream system with either a low or a high impedance.

In a preferred embodiment, the simulation method comprises a remote configuration step consisting of remotely configuring the microcontroller 6 as described above.

The simulator 1, as described above, thus offers a large number of advantages. In particular:

It is electronic type, and completely autonomous (without battery or battery);

it consumes very little energy;

it is easy to make;

it has a low overall dimension;

it requires little maintenance;

it enables one or more simulators to be reset (or re-prime) quickly and remotely;

it enables priming parameters to be set (trigger threshold, trigger delay time, etc.);

it enables the simulation of different types of primers;

it enables simulation of dispersions for the same type of primer; and it enables the event history to be stored in the non-volatile memory 13.

The invention claimed is:

1. A pyrotechnical ignition device simulator, said simulator being suitable for receiving an electrical firing pulse for activating a pyrotechnic ignition device, said simulator comprising:

a detection element capable of detecting at least one firing pulse received;

a microcontroller able to determine one or more characteristics of the firing pulse detected by the detection element and to drive an impedance block as a function of this or these characteristics, said microcontroller being able to be configured remotely;

said impedance block which is able to be simulated according to one of two different impedance values as a function of said characteristic or characteristics, one of said impedance values called high simulating an activation of the ignition device in response to the detected firing pulse and the other impedance value called low simulating an absence of activation of the ignition device in response to the detected firing pulse; and a charging element capable of recovering energy from a firing pulse received and charging a first energy reserve intended to supply electronic components of the simulator.

2. The simulator according to claim 1, further comprising a chip label capable of transmitting and receiving data remotely.

3. The simulator according to claim 2, wherein the chip label comprises an antenna and a non-volatile memory capable of recording the characteristic or the characteristics of a firing pulse, determined by the microcontroller.

4. The simulator according to claim 3, wherein the memory is powered by at least one of the following energies:

the energy stored when a firing impulse is received; and the energy supplied by a management device cooperating remotely with the chip label.

5. The simulator according to according to claim 1, wherein the charging element is able to charge a second energy reserve intended to supply the microcontroller in order to record in a memory the determined characteristic or characteristics of a firing pulse.

6. The simulator according to claim 1, wherein the microcontroller is able to determine at least one of the following characteristics of a detected firing pulse:

a current intensity of the firing pulse;

a duration of the firing pulse;

a maximum voltage measured; and a particular type of event concerning the firing pulse.

7. The simulator according to claim 6, wherein the microcontroller is also able to determine a number of firing pulses detected, when several firing pulses are detected.

8. The simulator according to claim 1, wherein the microcontroller is capable of being remotely configured for at least one of the following parameters:

a delay between a reception of a firing pulse and a corresponding simulation;

a minimum current for a firing pulse to be considered a correct firing pulse; and a duration of holding the impedance block at said high impedance value after the detection of a firing pulse.

9. The simulator according to claim 1, wherein the microcontroller is capable of being remotely controlled in order to bring the simulator, after a simulation following the detection of a firing pulse, into a state of being able to carry out a new simulation for a new firing pulse.

10. A pyrotechnic ignition device simulation system, comprising:

at least one pyrotechnic ignition device simulator according to claim 1, and a remote management device which is able to communicate via a wireless link with the pyrotechnic ignition device simulator.

11. The simulation system according to claim 10, further comprising a plurality of pyrotechnic ignition device simulators, wherein said management device is able to communicate with said plurality of pyrotechnic ignition device simulators.

12. A method of simulating a pyrotechnic ignition device, according to which method an electrical ignition pulse intended to activate a pyrotechnic ignition device can be received by a simulator, the method comprising:

a detection step consisting in detecting, with aid of a detection element of the simulator, at least one firing pulse received;

a control step consisting in determining, with the aid of a microcontroller of the simulator, one or more characteristics of the firing pulse detected in the detection step in order to drive an impedance block of the simulator as a function of this characteristic or these characteristics, said microcontroller being capable of being configured remotely; and a simulation step consisting in simulating said impedance block according to one of two different impedance values as a function of said characteristic or characteristics determined in the control step, one of said impedance values called high simulating an activation of the ignition device in response to the detected firing pulse and the other impedance value called low simulating an absence of activation of the ignition device in response to the detected firing pulse, the simulator comprising a charging element able to recover energy from a firing pulse received and to charge a first energy reserve intended to supply electronic components of the simulator.

13. The method according to claim 12, further comprising a remote configuration step for the microcontroller.

* * * * *